United States Patent [19]

Gould et al.

[11] 3,943,593

[45] Mar. 16, 1976

[54] DISPOSABLE ROTORY BRUSH CORE FOR POWER SWEEPER

[76] Inventors: William Gould; Charna Gould, both of 93 Sagamore Road, Millburn, N.J. 07041

[22] Filed: Nov. 18, 1974

[21] Appl. No.: 524,645

[52] U.S. Cl. ..... 15/179; 15/182; 29/117; 29/123

[51] Int. Cl.[2] ..... A46B 13/02

[58] Field of Search ..... 15/179, 181, 182, 183, 15/77, 102, 82, 230.11; 29/123, 124, 125, 117

[56] References Cited

UNITED STATES PATENTS

| | | | |
|---|---|---|---|
| 1,898,131 | 2/1933 | Jordan | 29/123 UX |
| 2,587,606 | 3/1952 | Dungler | 29/123 UX |
| 3,074,292 | 1/1963 | Polmon | 29/123 UX |
| 3,119,137 | 1/1964 | Schueler | 15/230.11 |
| 3,249,958 | 5/1966 | Haracz | 15/179 X |
| 3,340,558 | 9/1967 | Tamny | 15/182 |
| 3,694,844 | 10/1972 | Welter | 15/182 |
| 3,812,551 | 5/1974 | Mortensen | 15/180 |

*Primary Examiner*—Peter Feldman
*Attorney, Agent, or Firm*—Howard C. Miskin

[57] ABSTRACT

A power driven cylindrical rotary brush includes a drive shaft having affixed adjacent to one end a first splined inwardly directed frusto-conical plug having a peripheral flange at its base and having affixed adjacent its opposite end a circular plate having circumferentially spaced tapped bores. A cylindrical brush core provided with helically wound bristles has one end engaging the first plug. A second plug similar to the first plug engages the opposite end of the brush core and is bolted to the circular plate and is urged toward the first plug to wedge and deform the opposite end borders of the core. The first plug may be secured to the shaft in the manner of the first plug.

5 Claims, 3 Drawing Figures

DISPOSABLE ROTORY BRUSH CORE FOR POWER SWEEPER

BACKGROUND OF THE INVENTION

The present invention relates generally to improvements in power driven rotary brushes and it relates more particularly to an improved rotary brush assembly for mobile sweepers of the type provided with replaceable brush units.

The conventional mobile street sweeper is provided with power driven brushes or brooms, at least one of which is of cylindrical configuration. In the course of use, there brushes are subjected to extremely high abrasion and wear, resulting in a very short useful life, thereby necessitating their frequent and regular replacement. Labor costs being high, the quicker and easier the replacement of the brush, the more desirable the unit. A common form of replaceable cylindrical brush unit includes a tubular cylindrical core on which are mounted radially projecting bristles. The sweeper includes a motor driven drive shaft to which the brush unit is separably mounted. However, the coupling mechanism replaceably mounting the cylindrical brush unit to the drive shaft heretofore available and proposed possess numerous drawbacks and disadvantages. They are frequently unreliable devices which are complicated and expensive and require considerable time and skill for their operation in replacing a brush unit and otherwise leave much to be desired.

SUMMARY OF THE INVENTION

It is a principal object of the present invention to provide an improved power driven brush assembly.

Another object of the present invention is to provide an improved replaceable cylindrical brush assembly in a mobile sweeper.

Still another object of the present invention is to provide an improved mobile sweeper replaceable cylindrical brush assembly in which a brush unit can be easily and rapidly replaced with great precision.

A further object of the present invention is to provide a mechanism of the above nature characterized by its simplicity, ruggedness, reliability and great versatility and adaptability.

The above and other objects of the present invention will become aparent from a reading of the following description taken in conjunction with the accompanying drawing which illustrates a preferred embodiment thereof.

In a sense the present invention contemplates the provision of a power driven rotary brush assembly comprising a drive shaft, a first plug member mounted on the shaft proximate one end thereof and being rotatable therewith, a second plug member separably mounted on the shaft proximate the opposite end thereof and being rotatable with and axially adjustable along the shaft. The plug members have frusto-conical peripheral surfaces which are advantageously longitudinally serrated or splined, with the frusto-conical conical surfaces tapering axially toward each other. A replaceable cylindrical brush member includes a tubular cylindrical core coaxial with the shaft and outwardly directed bristles supported by the core, the inside diameter of the core being between the maximum and minimum diameters of the plug peripheral surfaces. The plug members enter and wedge opposite inside end borders of the core to provide a drive coupling between the shaft and replaceable brush unit. In the preferred form of the improved assembly the first plug member is affixed to the shaft although it may be axially adjustable like the second plug member. A disc or plate is affixed to the shaft proximate the inner end of the second plug member and is provided with circumferentially spaced tapped longitudinal bores which are engaged by bolts traversing corresponding bores formed in the second plug member inwardly.

The improved replaceable cylindrical brush assembly is simple, rugged and inexpensive and may be easily and rapidly operated in the replacement of a brush unit with a minimum of skill.

DESCRIPTION OF THE PREFERRED EMBODIMENT

Figure 1:
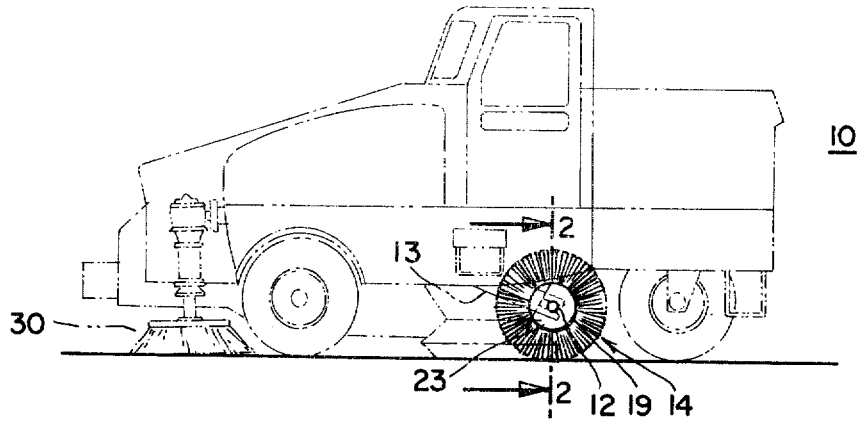
FIG. 1 is a side elevational view of a street sweeper shown by broken line employing a replaceable brush assembly embodying the present invention and shown by full line.
Figure 2:
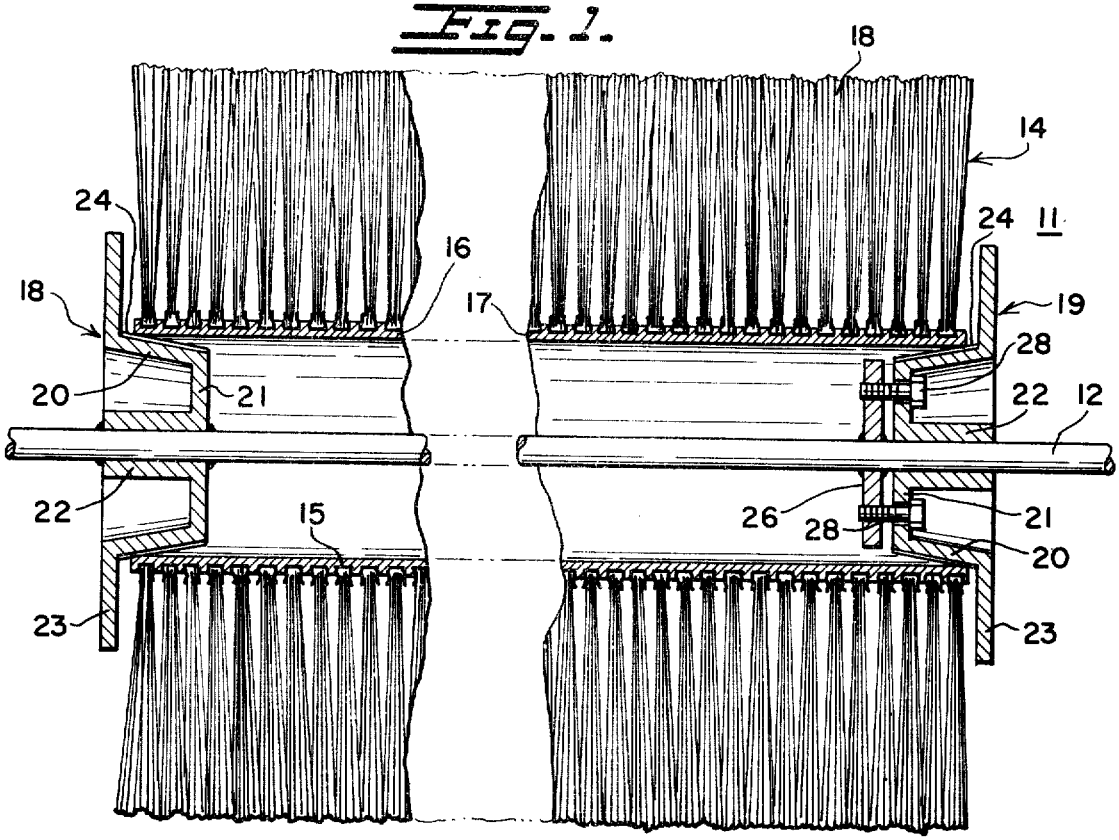
FIG. 2 is a medial longitudinal sectional view of the replaceable brush assembly taken along line 2—2 in FIG. 1.
Figure 3:
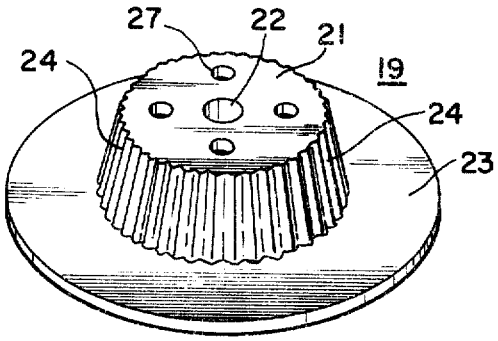
FIG. 3 is a perspective view of the separable plug unit forming a part of the assembly.

Referring now to the drawing which illustrates a preferred embodiment of the present invention, the reference numeral 10 generally designates a motor driven mobile street sweeper provided with the improved replaceable cylindrical brush assembly 11. The street sweeper 10 is of generally known or conventional construction and includes, in addition to one or more other power driven brushes 30, a cylindrical brush driving shaft 12 which extends transversely of the sweeper vehicle between the ends thereof and between and journalled to the free end sections of a pair of rearwardly downwardly inclined arms 13 and is rotated by the sweeper motor through a known drive transmission and in a known manner. Since the sweeper 10 and the mechanism for supporting and driving the shaft 12 are well known, these require no further explanation.

The assembly 11 comprises a replaceable cylindrical brush unit 14, which, in operative position, is coaxial with the drive shaft 12. The brush unit 14 includes a relatively thin walled tubular, hollow cylindrical core 16, having a helically extending groove 15 of small lead formed in its outer face and extending for substantially the full length of core 16, with successive convolutions of the helical groove 15 being closely spaced. A channel member 17 is firmly and securely affixed in and extends along the full length of the helical groove 15 and outwardly radially projecting bristles 32 of suitable material have their inner ends anchored in the channel member 17 in the known manner.

The brush unit 14 is replaceably mounted on and drive coupled to the shaft 12 by a pair of opposing first and second plug members 18 and 19 respectively. The plug members 18 and 19 are of generally similar configuration, each including a hollow frusto-conical section 20 at its inner smaller diameter end by a circular end wall 21 and open at its large outer end. A sleeve 22 is integrally formed with each end wall 21 and registers with a central opening therein and is coaxial with and coextensive with the length of the frusto-conical section 20. The outer enlarged end of each frusto-conical section 20 terminates in a radially outwardly directed peripheral flange 23. The outer face of each frusto-conical section 20 is longitudinally serrated to provide sharp apexed longitudinally extending ridges or splines 24 of generally triangular transverse cross section.

The first plug member 18 is affixed to the shaft 12 proximate a first end thereof with the closed end of the section 20 being directed toward the opposite second end of shaft 12. The sleeve 22 of the first plug member 18 tightly engages the shaft 12 and is firmly affixed thereto, such as by welding. Firmly affixed to the shaft 12 proximate its second end, such as by welding, is a coupling disc or plate 26 of about the diameter of end wall 21 and having a plurality of regularly circumferentially spaced tapped longitudinal bores formed therein.

The end wall 21 of the second plug member 19 has longitudinal bores 27 formed therein which are arranged and spaced the same as the tapped bores in disc 26. The second plug member 19 is mounted on shaft 12 with the sleeve 22 thereof slidably engaging shaft 12 and its closed inner end directed toward the shaft opposite end. The second plug member is secured to shaft 12 for rotation therewith and is axially inwardly adjustable by a plurality of bolts 28 which register with bores 27 and engage corresponding coaxially aligned tapped bores in coupling disc 26. The heads of bolts 28 engage the inside face of end wall 21 and are accessible to end wrenches or other tools through the open end of the second plug member. The inside diameter of the core 16 is between the maximum and minimim outside diameters of frusto-conical section 20.

In the assembled coupled condition of the brush unit 14 and shaft 12, the core 16 is coaxial with shaft 12 and its inside end borders are wedged by corresponding frusto-conical section 20 whose ridges bite into the inner faces of and slightly deform such end borders to effect a tight slip proof engagement between the confronting faces of the core 16 and the frusto-conical section 20. Such engagement and a precise coaxial relationship between the brush unit 14 and shaft 12 is effected merely by tightening the bolts 28.

In order to replace the brush unit 14 with a fresh brush unit, the bolts 28 are removed by means of an end wrench or the like and the second plug member 19 withdrawn from the core 16 and shaft 12 using the corresponding flange 23 as a pulling surface. The brush unit 14 is then merely rocked to disengage it from the first plug member 18 and is quickly and completely separated. A fresh brush unit 14 is then advanced over the shaft and brought into engagement with the first plug frusto-conical section, the second plug is replaced with the bores 27 in alignment with the coupling disc tapped bores and the bolts 28 reapplied. The bolts 28 are then tightened to effect a sufficient wedging and engagement of the frusto-conical sections 20 with the core 16 under which conditions the brush unit 14 and shaft 12 are in firm coaxial drive coupling.

While there has been described and illustrated a preferred embodiment of the present invention, it is apparent that numerous alterations, omissions and additions may be made without departing from the spirit thereof.

What I claim is:

1. A power driven rotary brush assembly comprising a drive shaft, a first plug member mounted proximate one end of said shaft and rotatable therewith, a second plug member mounted proximate on opposite end of said shaft and separable from said shaft, a coupling member affixed to said shaft axially inwardly of and proximate the inner end of said second plug member coupling means for separably connecting said second plug member to said coupling member by rotation therewith and for axially adjustably advancing said second plug member toward said coupling member, said plug members having frustoconical peripheral surfaces coaxial with said shaft tapering inwardly toward each other, and a brush member including a deformable tubular cylindrical core coaxial with said shaft and outwardly directed bristles supported by said core, said core having an inside diameter between the maximum and minimum diameter of said plug member frustoconical peripheral surfaces, and said plug members entering opposite ends of said core and wedge engaging and deforming the opposite inside borders of siad core to provide drive couplings therewith.

2. The rotary brush assembly of claim 1 wherein each of said plug member frusto-conical surfaces is longitudinally serrated.

3. The rotary brush assembly of claim 2 including an outwardly directed peripheral flange formed at the base end of each of said plugs.

4. The rotary brush assembly of claim 1 wherein said coupling member comprises a disc having circumferentially spaced tapped longitudinal first bores and said second plug member has second bores formed therein coaxial with said first bores and said coupling means comprises bolts engaging respective coaxial pairs of said bores to couple said second plug member and draw it toward said disc and tightly wedge it within said core.

5. The rotary brush assembly of claim 4 wherein said second plug member is hollow and is open at its outer end and provided with an end wall at its inner end, said second bores being formed in said end wall, and a coaxial sleeve formed on said end wall and slidably engaging said shaft.

* * * * *